US012497862B2

(12) United States Patent
Hegna

(10) Patent No.: US 12,497,862 B2
(45) Date of Patent: Dec. 16, 2025

(54) HYDRATE REMOVAL IN HYDROCARBON WELLS

(71) Applicant: CONOCOPHILLIPS COMPANY, Houston, TX (US)

(72) Inventor: Rolf Hegna, Tananger (NO)

(73) Assignee: CONOCOPHILLIPS COMPANY, Houston, TX (US)

( * ) Notice: Subject to any disclaimer, the term of this patent is extended or adjusted under 35 U.S.C. 154(b) by 0 days.

(21) Appl. No.: 18/788,251

(22) Filed: Jul. 30, 2024

(65) Prior Publication Data

US 2025/0043659 A1 Feb. 6, 2025

Related U.S. Application Data

(60) Provisional application No. 63/530,638, filed on Aug. 3, 2023.

(51) Int. Cl.

| | |
|---|---|
| ***E21B 36/04*** | (2006.01) |
| ***E21B 37/00*** | (2006.01) |
| *E21B 41/00* | (2006.01) |

(52) U.S. Cl.

CPC ..... *E21B 36/04* (2013.01); *E21B 37/00* (2013.01); *E21B 41/0099* (2020.05)

(58) Field of Classification Search

CPC ..... E21B 36/04; E21B 37/00

See application file for complete search history.

(56) References Cited

U.S. PATENT DOCUMENTS

| | | | | |
|---|---|---|---|---|
| 4,678,034 | A | 7/1987 | Eastlund et al. | |
| 4,856,593 | A | 8/1989 | Mathews et al. | |
| 6,307,191 | B1 | 10/2001 | Waycuilis | |
| 7,975,763 | B2 | 7/2011 | Banerjee et al. | |
| 8,365,823 | B2 | 2/2013 | Dreher et al. | |
| 8,431,015 | B2 | 4/2013 | Banerjee et al. | |
| 8,464,789 | B2 | 6/2013 | Banerjee et al. | |
| 8,555,970 | B2 | 10/2013 | Wheeler et al. | |
| 9,004,164 | B2 | 4/2015 | Dreher et al. | |
| 10,053,959 | B2 * | 8/2018 | Ayub | E21B 47/07 |
| 2013/0020128 | A1 | 1/2013 | Calleri | |
| 2014/0027109 | A1 | 1/2014 | Al-Buraik | |
| 2016/0251940 | A1 * | 9/2016 | De Witt | E21B 7/14 166/304 |

FOREIGN PATENT DOCUMENTS

| | | |
|---|---|---|
| SU | 1739011 A1 | 6/1992 |
| WO | 2009085347 | 7/2009 |
| WO | 2021023978 | 2/2021 |

OTHER PUBLICATIONS

International Search Report for PCT/US2024/040122 mailed Dec. 31, 2024; 3 pgs.

* cited by examiner

*Primary Examiner* — Robert E Fuller

(74) *Attorney, Agent, or Firm* — CONOCOPHILLIPS COMPANY

(57) ABSTRACT

A process for removing an obstruction (13) caused by gas hydrates or water ice from the tubing (12) of a hydrocarbon production or injection well or a riser using a microwave. The process comprises passing a microwave generating and emitting tool (5) on wireline (8) down the tubing (12) and supplying electrical power to the tool via the wireline (8) or from a battery to produce microwave energy and direct it to the gas hydrate and/or water ice deposit (13), thereby melting deposit and unblocking the well.

14 Claims, 2 Drawing Sheets

HYDRATE REMOVAL IN HYDROCARBON WELLS

CROSS-REFERENCE TO RELATED APPLICATIONS

This application is a non-provisional application which claims benefit under 35 USC § 119 (e) to U.S. Provisional Application Ser. No. 63/530,638 filed Aug. 3, 2023, entitled "Hydrate Removal in Hydrocarbon Wells," which is incorporated herein in its entirety.

FEDERALLY SPONSORED RESEARCH AND DEVELOPMENT

None.

FIELD OF THE INVENTION

This invention relates to the removal of unwanted build-up of water ice and/or methane hydrate complexes in hydrocarbon wells, which may obstruct wells and, e.g., reduce production of hydrocarbons from a producing well.

BACKGROUND OF THE INVENTION

Hydrate formation is a problem in production and injection wells in oil and gas production. The theory is well-known, that free water and natural gas (methane), under certain conditions of elevated pressure and low temperatures, form solid hydrate complexes. These complexes, sometimes called clathrates or gas hydrates, are crystalline water-based solids physically resembling ice, in which hydrocarbon molecules, most commonly methane, are trapped inside "cages" of water molecules.

In a wellbore, the build-up of such complexes can limit and eventually block all flow. Hydrates can also form in the tubing in risers, i.e. tubing extending between the seafloor and a production platform. Hydrates are a problem both in offshore and onshore wells. They occur when temperatures are low, for example in subsea wells and in onshore wells where the well extends through permafrost. However, at high pressures hydrates can also form at higher temperatures, e.g. at 50 bar a hydrate can form at 14 degrees C.

Current methods for removal of hydrates are time-consuming mechanical or chemical processes to remove the plugging. For example, the hydrate may be milled out using a downhole tool or, more commonly, a chemical such as methanol or glycol may be introduced into the well to dissolve, melt or otherwise break down the solid hydrate. The delivery of chemicals may be combined with depressurizing the well to facilitate melting of the hydrate.

Downhole milling is an expensive procedure, potentially involving a drilling rig, and is also time-consuming.

Chemical treatment is more common. Current practice commonly involves simply injecting a chemical such as methanol or glycol into the well when it is suspected that hydrates are present. It can take several weeks for the hydrate to be removed, during which time the well is unproductive. In some cases, water ice is sandwiched between regions of hydrate, which can make chemical treatment difficult.

In the past, chemical treatment has been combined with depressurizing the well to help melt the hydrate. This can be dangerous, however, since when the hydrate blockage is removed the region of the well above the blockage is suddenly subject to increased pressure which can, e.g. cause tools to be forced up out of the well. Most hydrate plugs form right at the top of production and injection wells, after the downhole safety valve and the wellhead.

In subsea wells, it is not an option to depressurize. Hydrates are especially difficult to manage in subsea wells because of the increased difficulty in accessing the well.

There is therefore an unmet need for a way to remove hydrates from the tubing of hydrocarbon wells (especially subsea wells) or risers that has improved safety, is more convenient, takes less time and/or is less expensive than previous methods.

U.S. Pat. No. 6,307,191B1 (Marathon) describes the removal of hydrates from pipelines using microwave energy. U.S. Pat. No. 4,678,034A (Eastlund) describes the use of microwaves to prevent deposition of solids in producing wells, but does not mention hydrates.

BRIEF SUMMARY OF THE DISCLOSURE

An embodiment of the invention more particularly includes a process for removing an obstruction caused by gas hydrates or water ice from the tubing of a hydrocarbon production or injection well or a riser, wherein the process comprises: a) passing a microwave generating and emitting tool on wireline down the tubing; b) supplying electrical power to the microwave generating and emitting tool from a battery pack in the tool or via the wireline to produce microwave energy and direct it to a gas hydrate and/or water ice deposit; thereby at least partially melting and/or decomposing the gas hydrate and/or water ice deposit.

Wireline is a convenient and relatively inexpensive way of conducting interventions in wells, especially subsea wells. Wireline operations can be performed without depressurizing a well; this is especially important in subsea wells where depressurizing the well is not normally a viable option. Wireline operations in a subsea well, the inventors believe, could be accomplished using a light well intervention vessel with appropriate wireline reel, power supply and associated control and connection equipment.

The inventors believe sufficient microwave energy for this purpose could be created within the limits of the power that can be provided by a battery pack or transmitted down wireline, whereas melting or decomposing hydrate or ice in a reasonable time frame using thermal energy would likely require more power than could be transmitted down wireline or provided by a battery. Microwave energy is more easily focused on the area of interest. Furthermore, microwave energy of approximately 2.4 GHz would, the inventors believe, specifically excite water molecules in a hydrate complex thereby efficiently breaking down the complex.

The inventors believe that melting or decomposing hydrate or water ice using microwave energy could be accomplished in much less time than using chemical means.

Electrical power supplied to the microwave tool may be between 500 and 10,000 Watts, optionally between 1,000 and 5,000 Watts, such as about 2,000 Watts. Microwave energy may be directed distally along the tubing by the tool, that is to say towards a mass of hydrate or water ice obstructing the tubing.

After melting or decomposing a portion of hydrate or ice, the tool may be advanced through the melted or decomposed hydrate or ice, along the tubing, to melt or decompose further hydrate or ice. The weight of the tool may be sufficient to advance it along the tubing until it reaches solid hydrate or ice, and continuously to advance it through melted or decomposed hydrate or ice. If a battery pack is used to power the tool, the weight of the battery pack could assist the downward movement of the tool. The additional weight could also be an advantage in the event that a high pressure region of the well below an ice or hydrate deposit is exposed once the deposit is eliminated, which will tend to push the tool upwards (proximally). Uncontrolled upward movement of the tool can be a hazard.

The hydrate or ice to be decomposed or melted may be in a subsea well; such wells are harder to access since the wellhead is on the seafloor rather than on a platform but wireline provides a relatively convenient way to perform operations in such wells. The tool may be delivered from a surface vessel with a wireline facility (e.g. a so-called riserless light well intervention vessel), rather than requiring an expensive drilling rig.

The deposit may comprise a region of water ice and a region of hydrate, e.g. a region or regions of water ice sandwiched between regions of hydrate. In such circumstances it can be hard to remove the obstruction chemically since different chemicals may be required efficiently to treat water ice or hydrate. At any given time during the operation, it may be uncertain whether water ice or hydrate is to be melted or decomposed. However, the inventors believe microwave energy may equally effectively melt or decompose either water ice or hydrate.

The process may include recovering the tool by directing microwave energy proximally to melt or decompose re-formed hydrate or ice to allow the tool to be withdrawn. It is possible that hydrate or ice could re-form above the tool after it has melted and passed through a deposit. This could make the tool hard to recover, so the tool may include means to direct microwave energy proximally (upwardly) to allow it to re-melt ice/hydrate deposits and allow the tool to be withdrawn from the well.

The process may include sensing slackening of tension in the wireline or proximal acceleration of the tool and then activating a braking system to restrain proximal movement of the tool. If a hydrate or ice deposit is melted and there is high pressure fluid beyond the deposit, this may cause the tool to be propelled rapidly upwards/proximally. An automatic braking system could mitigate this problem.

In another embodiment, the invention includes a tool for removing an obstruction caused by gas hydrates or water ice from the tubing of a hydrocarbon production or injection well or a riser, wherein the tool is adapted for delivery on wireline into the tubing and wherein the tool comprises:

a) a microwave generator adapted to receive electrical power from a battery pack in the tool or via the wireline; and
b) a microwave antenna adapted to deliver microwave energy in a distal direction when the tool is located in the well.

The tool may advantageously include a ground/earth contact member arranged to contact the interior surface of the tubing so that the tubing acts as a Faraday cage. In this way, microwave energy may be contained within the well.

The microwave generator may have an input power rating between 500 Watts and 10,000 Watts, optionally between 1,000 Watts and 5,000 Watts, such as about 2,000 Watts.

The tool may comprise two or more antennas for directing microwave energy distally. Having multiple antennas can help prevent dead spots in the applied microwave energy field.

The tool may also comprise an antenna for directing microwave energy proximally, for use if ice or hydrate re-forms or partially re-forms, making removal of the tool difficult. Proximally directed microwave energy may re-melt the deposit to allow withdrawal of the tool.

The tool may comprise a sensor for sensing slackening of tension in the wireline or a sensor for sensing proximal acceleration of the tool, together with a system for braking the tool, e.g. by means of a braking member engaging the interior tubing wall, to restrain proximal movement of the tool in response to slackening of tension in the wireline or proximal acceleration of the tool being sensed. If the tool encounters high pressure fluid beyond a melted ice or hydrate deposit, this system may help prevent the tool being forced back up the well in an uncontrolled manner.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

As used herein, the term "wireline" refers to wire used to deliver tools downhole, to deliver electrical power to the tools and/or to transmit data to and from the tools. As used herein, the term "wireline" includes so-called slickline and so-called "e-line". Slickline is a simple load-bearing wire, whereas e-line comprises a braided outer sheath and a central electrical conductor.

As used herein, the term "subsea well" means a production or injection well having a wellhead on the seafloor.

As used herein, the term "tubing" refers to production tubing or to tubing of an injector well through which fluid is flowed into a formation.

As used herein, the terms "distal" and "proximal" are used in connection with a well to mean with respect to the surface. Thus, "distal" means remote from the surface and "proximal" means nearer to the surface.

Additionally, any examples or illustrations given herein are not to be regarded in any way as restrictions on, limits to, or express definitions of, any term or terms with which they are utilized. Instead, these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

BRIEF DESCRIPTION OF THE DRAWINGS

A more complete understanding of the present invention and benefits thereof may be acquired by referring to the following description taken in conjunction with the accompanying drawings.

DETAILED DESCRIPTION OF THE INVENTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
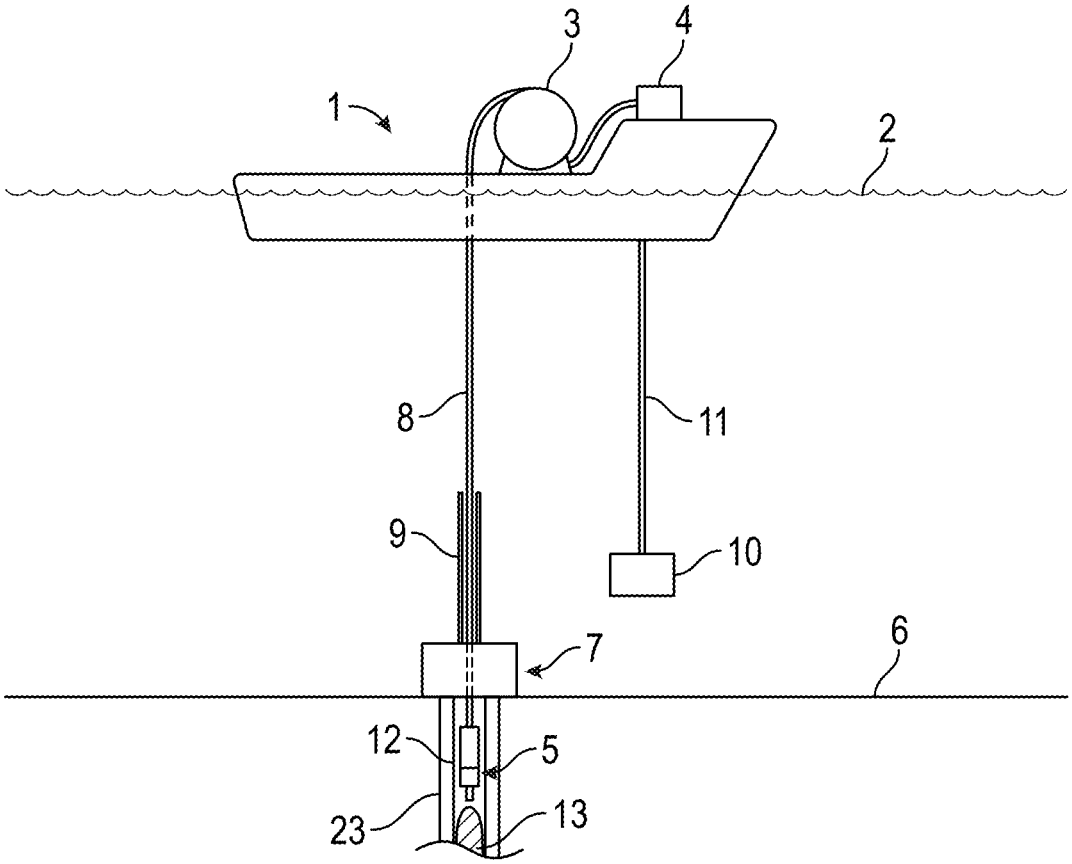
FIG. 1 is a schematic showing a light well intervention vessel deploying a microwave tool on wireline into a subsea well in a method according to the invention.

As shown in FIG. 1, a light well intervention vessel 1 may be deployed at the surface 2, having wireline capability including a reel of wireline and associated equipment shown generally at 3, together with an electric power supply 4. A microwave tool shown generally at 5 is lowered to the seafloor 6 on wireline 8. On the seafloor 6 is a wellhead 7 with a wireline riser 9 extending upwardly from the wellhead 7 and a well with casing 23 extending through the seafloor. Production tubing 12 extends through the casing. The wireline 8 passes into the subsea wellhead 7 and then into the well tubing 12, via the wireline riser 9. The operation of introducing the wireline 8 into the wellhead 7 may be assisted by a remote operated subsea vehicle (ROV) 10 controlled by an umbilical 11 from the vessel 1. All these items and their operation are familiar to those skilled in this field, and will not be described in detail.

Figure 2:
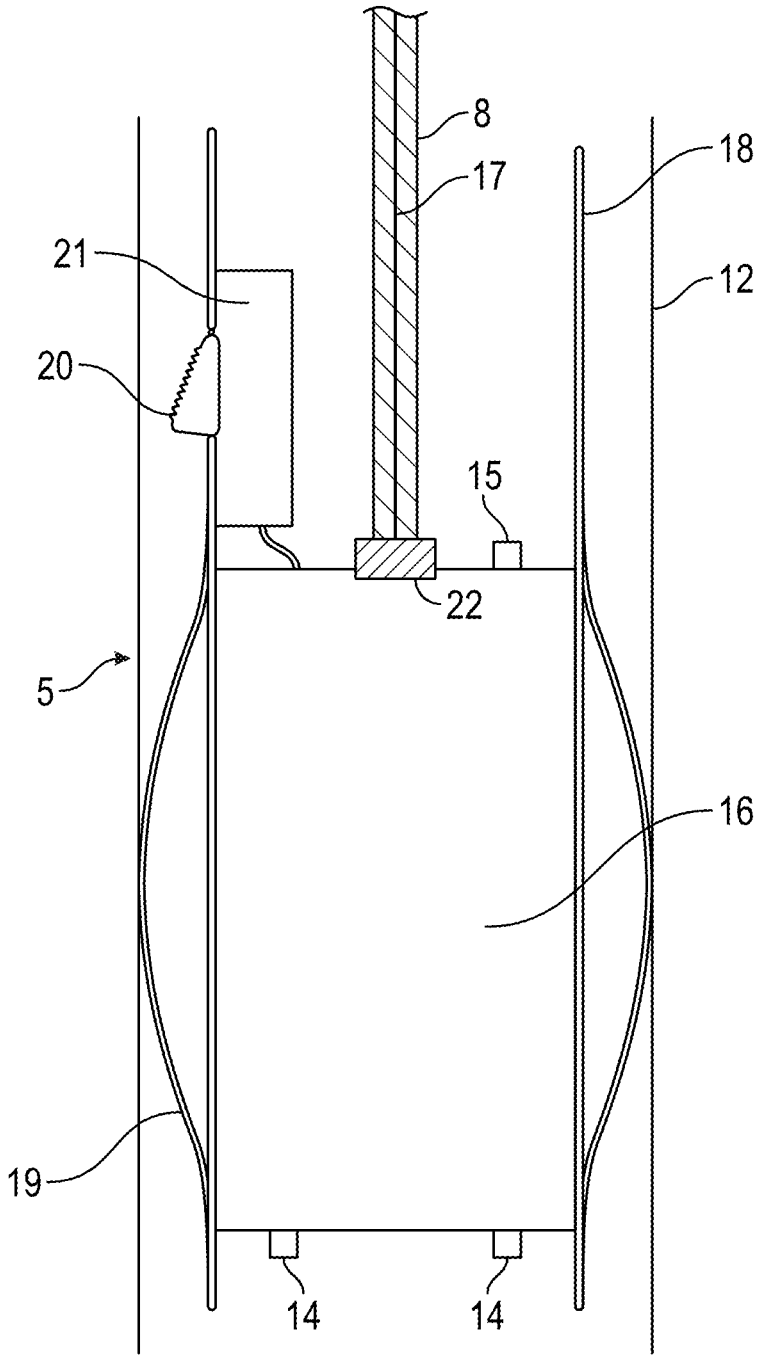
FIG. 2 is a schematic representation of a downhole microwave tool according to the invention.

The microwave tool 5 is shown in the well tubing 12 adjacent a blockage 13 comprising hydrate. The tool 5 is shown in slightly more detail in FIG. 2, where similar reference numerals denote the same components as in FIG. 1. The tool in fact is several meters long; the aspect ratio has been changed in the drawings to aid clarity. The tool 5 comprises a robust housing 18. Within the housing 18 is a microwave generator 16 connected to an electric power line 17 within the wireline 8, which draws electric power from the supply 4 on the vessel. In an alternative embodiment of the invention, power may be supplied from a battery in the tool.

The microwave generator is designed to generate microwave signals with frequency 2.45 GHz and to emit microwaves from antennas 14 in a distal direction (i.e. down the well). The well tubing 12 acts as a Faraday cage and/or waveguide containing the microwave energy and directing it along the tubing 12 in a distal direction towards the hydrate deposit 13. The device is earthed to the tubing 12 by means of flexible contacts 19. Two antennas 14 are shown; it is preferable to have two or more antennas since the standing wave generated by a single antenna may have dead spots. Two or more antennas may be arranged so as to reduce or eliminate dead spots.

When flow from a producing well is reduced or even stopped and it is believed that a build-up of hydrates and/or water ice in the well may be the cause, a so-called riser-less light well intervention vessel (RLWI vessel) is brought in. A microwave tool, as described above, may be lowered on wireline from the vessel. The wireline comprises a coaxial arrangement of load-bearing braided wire, with a central electrical conductor wire. A subsea remotely operated vessel (subsea ROV) is deployed from the RLWI vessel and used to open the necessary valves and access points and to help manipulate the microwave tool into the wellhead and allow it to be lowered into the well. The tool continues to be lowered under its own weight through the well until it encounters an obstruction, believed to be hydrate and/or water ice. Powered from the power supply on the RLWI vessel, the microwave tool generates and delivers microwave energy focused down the well towards the hydrate/water ice blockage. The input power drawn by the microwave tool is approximately 2 kW, which is within the capacity of the type of wireline used. If necessary, a higher-powered microwave generator could be used, depending on the type of wireline employed.

The hydrate or ice deposits are normally formed only a few metres into the well (or riser), often just below the downhole safety valve if in a well. It is therefore a relatively quick operation to pass the wireline into the well as far as the deposit. The capacity of wireline to carry electric power can depend on the length of line; because only a short length is required, it may be within specification to deliver up to 10 KW of electric power to the microwave device. However, it is also possible that lower power devices may be sufficient, e.g. as low as 500 Watts. With modern lithium ion batteries, these power levels can also be reached.

Microwave generators are inherently efficient. The well casing may act to reflect and contain microwave energy within the well, and the antenna and waveguide on the tool can direct the energy to the desired location. Microwave energy of 2.45 GHz almost exclusively excites water molecules. All of these factors mean that the energy transmitted down the wireline is likely to be transferred with high efficiency into the water ice or hydrate causing the blockage, resulting in fast liquefaction of the ice/hydrate and removal of the blockage.

As water/hydrate is liquefied, the tool is allowed to continue its descent under its own weight, passing through the liquefied hydrate/water and directing microwave energy distally, towards new un-liquefied hydrate/water until the blockage is completely removed.

Once the blockage is removed, the wireline is withdrawn and the well put back on production. A proximal antenna 15 is provided and energy from the microwave generator 16 may be selectively applied to this antenna if it is determined that the tool is stuck in the well. In this event it is possible that hydrate or ice has re-formed above the tool and obstructed withdrawal of the tool; directing energy proximally may melt the re-formed ice or hydrate and allow the tool to be withdrawn. The control of which antenna to energize may be via signals passed down the wireline to the device.

The tool is equipped with a brake 20 that may be engaged with the interior surface of the tubing 12 to arrest undesirable movement of the tool. When a hydrate or ice deposit is melted, it is possible that the fluid beyond the deposit is at relatively high pressure. This may result in the tool being forced upwards (proximally), potentially at high speed. This is undesirable and can be dangerous, so the main purpose of the brake 20 is to prevent such movement. The tool is equipped with a sensor 22 for sensing when tension in the wireline 8 is reduced, indicating that the tool may be subject to an upward force. A brake actuator mechanism 21, powered via the wireline, engages the brake on receipt of a signal from the sensor 22.

It is also envisaged that the system could be used with offshore dry wellheads located on an offshore platform, or with onshore wells where low temperatures may cause hydrates and/or water ice to form in hydrocarbon wells. In offshore dry wellheads, where a riser extends between the wellhead and the seafloor, hydrates may form in the riser as well as in the well itself. The invention is equally applicable to these situations, where access to the wellhead is relatively simple compared to a subsea wellhead. In these situations too, the use of a microwave energy generating and emitting tool is likely, the inventors believe, to result in much shorter times for decomposing and/or melting hydrate and/or water ice deposits causing blockages in wells or risers.

Hydrates may form in onshore wells that pass through permafrost. In this situation, melting of the hydrates using heat is undesirable since the rig/wellhead is built upon the permafrost and to partially melt it could disturb the foundations of the rig. For this reason, wells passing through permafrost are in fact normally insulated to prevent the permafrost being affected. Microwave melting of hydrates, as discussed above, should contain the microwave energy within the tubing and thus nor affect the permafrost.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

It should be understood that the inventive features and concepts may be manifested in other arrangements and that the scope of the invention is not limited to the embodiments described or illustrated. The scope of the invention is intended only to be limited by the scope of the claims that follow. At the same time, each and every claim below is hereby incorporated into this detailed description or specification as an additional embodiments of the present invention.

REFERENCES

All of the references cited herein are expressly incorporated by reference. The discussion of any reference is not an admission that it is prior art to the present invention, especially any reference that may have a publication date after the priority date of this application. Incorporated references are listed again here for convenience:

1) U.S. Pat. No. 4,678,034, Eastlund, et al., "Well heater," (1987).
2) U.S. Pat. No. 4,856,593, Mathews, R. R. & Clark, C. R., "Inhibition of hydrate formation," (1987).
3) U.S. Pat. No. 6,307,191, John J. Waycuilis, "Microwave heating system for gas hydrate removal or inhibition in a hydrocarbon pipeline," (2001).
4) U.S. Pat. No. 7,975,763, Banerjee, D. K. & Stalder, J. L., "Process for enhanced production of heavy oil using microwaves," (2008).
5) U.S. Pat. No. 8,365,823, Dreher, et al., "In-situ upgrading of heavy crude oil in a production well using radio frequency or microwave radiation and a catalyst," (2009).
6) U.S. Pat. No. 8,431,015, Smith, K. W. & Banerjee, D. K., "Wellhead hydrocarbon upgrading using microwaves," (2009).
7) U.S. Pat. Nos. 8,464,789, 8,720,547, 8,689,865, 8,720,548, 8,720,549, 8,720,550, 8,905,127, Banerjee, et al., "Process for enhanced production of heavy oil using microwaves," (2010).
8) U.S. Pat. No. 8,555,970, Wheeler, et al., "Accelerating the start-up phase for a steam assisted gravity drainage operation using radio frequency or microwave radiation," (2009).
9) U.S. Pat. No. 9,004,164, Dreher, et al., "In situ radio frequency catalytic upgrading," (2011).

The invention claimed is:

1. A process for removing an obstruction caused by gas hydrates or water ice from tubing of a hydrocarbon production or injection well or a riser, wherein the process comprises:

a) passing a microwave generating and emitting tool on wireline down the tubing;

b) supplying electrical power to the microwave generating and emitting tool either from b) a battery package in the tool or via the wireline, to produce microwave energy and direct it distally along the tubing to a gas hydrate and/or water ice deposit, thereby at least partially melting and/or decomposing the gas hydrate and/or water ice deposit; and c) recovering the tool by directing microwave energy proximally to melt or decompose re-formed hydrate or ice to allow the tool to be withdrawn.

2. The process according to claim 1, wherein the electrical power supplied to the tool is between 500 and 10,000 Watts.

3. The process according to claim 1, wherein, after melting or decomposing a portion of hydrate or ice, the tool is advanced through the melted or decomposed hydrate or ice, along the well or riser, to melt or decompose further hydrate or ice.

4. The process according to claim 3, wherein the weight of the tool is sufficient to advance it along the tubing until it reaches solid hydrate or ice.

5. The process according to claim 1, wherein the hydrate or ice is in a subsea well.

6. The process according to claim 1, wherein the tool is delivered from a surface vessel with a wireline facility.

7. The process according to claim 1, wherein the deposit comprises a region of water ice and a region of hydrate.

8. The process according to claim 1, wherein the process includes sensing slackening of tension in the wireline or sensing proximal acceleration of the tool and then activating a braking system to restrain proximal movement of the tool.

9. A tool for removing an obstruction caused by gas hydrates or water ice from tubing of a hydrocarbon production or injection well or a riser, wherein the tool is adapted for delivery on wireline into the tubing and wherein the tool comprises:

a) a microwave generator adapted to receive electrical power from a battery pack in the tool or via the wireline; and b) a microwave antenna adapted to deliver microwave energy in a distal direction when the tool is located in the tubing; and c) an antenna for directing microwave energy in a proximal direction to melt or decompose re-formed hydrate or ice to allow the tool to be withdrawn.

10. The tool according to claim 9, including a ground/earth contact member arranged to contact the interior surface of the tubing of so that the tubing acts as a Faraday cage.

11. The tool according to claim 9, wherein the microwave generator has an input power rating between 500 Watts and 10,000 Watts.

12. The tool according to claim 9, wherein the tool further comprises at least one additional antenna for directing microwave energy.

13. The tool according to claim 9, wherein the tool comprises:

a) a sensor for sensing slackening of tension in the wireline or a sensor for sensing proximal acceleration of the tool; and b) a system for braking the tool in response to sensed slackening of tension in the wireline or in response to sensed proximal acceleration.

14. The tool according to claim 13, wherein the system for braking comprises a braking member engageable with the interior tubing wall to restrain movement of the tool.

* * * * *